US010352553B2

(12) United States Patent
Penrod et al.

(10) Patent No.: US 10,352,553 B2
(45) Date of Patent: Jul. 16, 2019

(54) APPARATUS FOR PRODUCING LIGHT AND SOUND

(71) Applicant: HALLMARK CARDS, INCORPORATED, Kansas City, MO (US)

(72) Inventors: Jason B. Penrod, Shawnee, KS (US); Douglas L. Krivanek, Lenexa, KS (US); Ivan B. Helmirch, Kansas City, MO (US); Christopher J. Shields, Kansas City, MO (US)

(73) Assignee: Hallmark Cards, Incorporated, Kansas City, MO (US)

( * ) Notice: Subject to any disclaimer, the term of this patent is extended or adjusted under 35 U.S.C. 154(b) by 158 days.

(21) Appl. No.: 15/261,694

(22) Filed: Sep. 9, 2016

(65) Prior Publication Data

US 2017/0089567 A1 Mar. 30, 2017

Related U.S. Application Data

(60) Provisional application No. 62/235,265, filed on Sep. 30, 2015.

(51) Int. Cl.

| | |
|---|---|
| ***F21V 33/00*** | (2006.01) |
| ***F21V 3/02*** | (2006.01) |
| ***F21V 23/00*** | (2015.01) |
| ***F21S 9/02*** | (2006.01) |
| ***H04R 1/02*** | (2006.01) |
| *F21W 121/00* | (2006.01) |
| *F21Y 115/10* | (2016.01) |
| *F21Y 113/17* | (2016.01) |
| *F21V 23/04* | (2006.01) |
| *F21S 10/04* | (2006.01) |

(52) U.S. Cl.

CPC ..... *F21V 33/0056* (2013.01); *F21S 9/02* (2013.01); *F21V 3/02* (2013.01); *F21V 23/003* (2013.01); *H04R 1/028* (2013.01); *F21S 10/043* (2013.01); *F21V 23/0471* (2013.01); *F21W 2121/00* (2013.01); *F21Y 2113/17* (2016.08); *F21Y 2115/10* (2016.08)

(58) Field of Classification Search

CPC ..... F21V 33/0056; F21V 3/02; F21V 23/003; F21V 23/0471; F21S 9/02; F21S 10/043; H04R 1/028; F21Y 2113/17; F21Y 2115/10; F21W 2121/00

USPC ..... 362/86

See application file for complete search history.

(56) References Cited

U.S. PATENT DOCUMENTS

2010/0302912 A1* 12/2010 Gordon ..... G04G 11/00 368/109

* cited by examiner

*Primary Examiner* — Elmito Breval
*Assistant Examiner* — Hana S Featherly
(74) *Attorney, Agent, or Firm* — Shook, Hardy & Bacon L.L.P.

(57) ABSTRACT

Aspects of the present invention generally relate to an apparatus that combines a light source, a speaker, and other electrical components in a single unit to produce lighting and sound effects. The apparatus may be sized and configured for use in a number of applications. Further, the apparatus may have a number of operating states that may include light and sound effects that correspond with one another.

15 Claims, 5 Drawing Sheets

APPARATUS FOR PRODUCING LIGHT AND SOUND

CROSS-REFERENCE TO RELATED APPLICATIONS

This application claims priority to U.S. Provisional Patent Application No. 62/235,265, entitled "Apparatus for Producing Light and Sound," filed Sep. 30, 2015, the entirety of which is hereby incorporated by reference.

STATEMENT REGARDING FEDERALLY SPONSORED RESEARCH OR DEVELOPMENT

Not applicable.

TECHNICAL FIELD

Embodiments of the present invention relate to a discrete apparatus for producing lighting and sound effects.

BRIEF SUMMARY OF THE INVENTION

The invention is defined by the claims below. This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

Aspects of the present invention generally relate to an apparatus that combines a light source, a speaker, and other electrical components, in a single unit to produce lighting and sound effects. By combining the components into one easy-to-use unit, the apparatus can be utilized in a variety of applications. For example, the apparatus may be sized and configured to be placed in home decor products that typically hold battery-operated and/or standard candle tea lights. In other aspects, the apparatus may be variably-sized and configured for use in any number of items, such as costumes, decor, jack-o-lanterns, light-up trick-or-treat bags/buckets, among others. In other aspects, the apparatus may be used as a stand-alone decoration, or in existing products, such as Gloominaries™ from Hallmark®.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Figure 1:
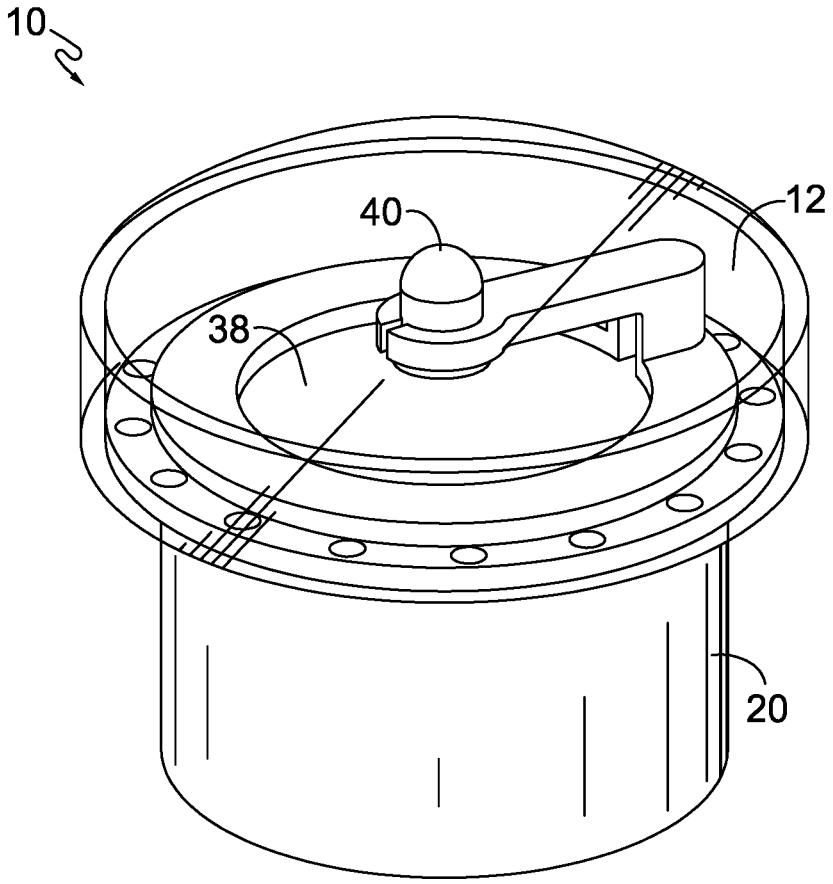
FIG. 1 is a top perspective view of an apparatus for producing light and sound, in accordance with an embodiment of the present invention.

As briefly described hereinabove, the present invention generally relates to an apparatus for producing light and sound ("apparatus"). Accordingly, FIG. 1 shows an exemplary embodiment of the apparatus 10. The apparatus 10 includes a housing 20 that contains or supports a number of electrical components, including a light source 40 and a speaker 38, for producing lighting and sound effects. The apparatus 10 also includes a cap 12 that covers the light source 40 and allows light to pass through the cap 12, thereby creating an illuminating effect. In some aspects, the cap 12 may be removeably coupled with the housing 20, such that the light source 40 and other components may be accessed when the cap 12 is removed. Additional components received within the housing 20 will be described in more detail below with reference to FIG. 2.

The apparatus 10 may be produced in a variety of shapes and sizes. The shape and/or size of the apparatus 10 may be determined by an intended use or implementation of the apparatus 10. As such, in one aspect, the housing 20 may be compact, such that the apparatus 10 fits in standard tea light candle holders. In another example, the apparatus 10 may be configured for use in a jack-o'-lantern, and may include a larger housing 20 that contains larger (or additional) light sources, power sources, and/or speakers.

Figure 2:
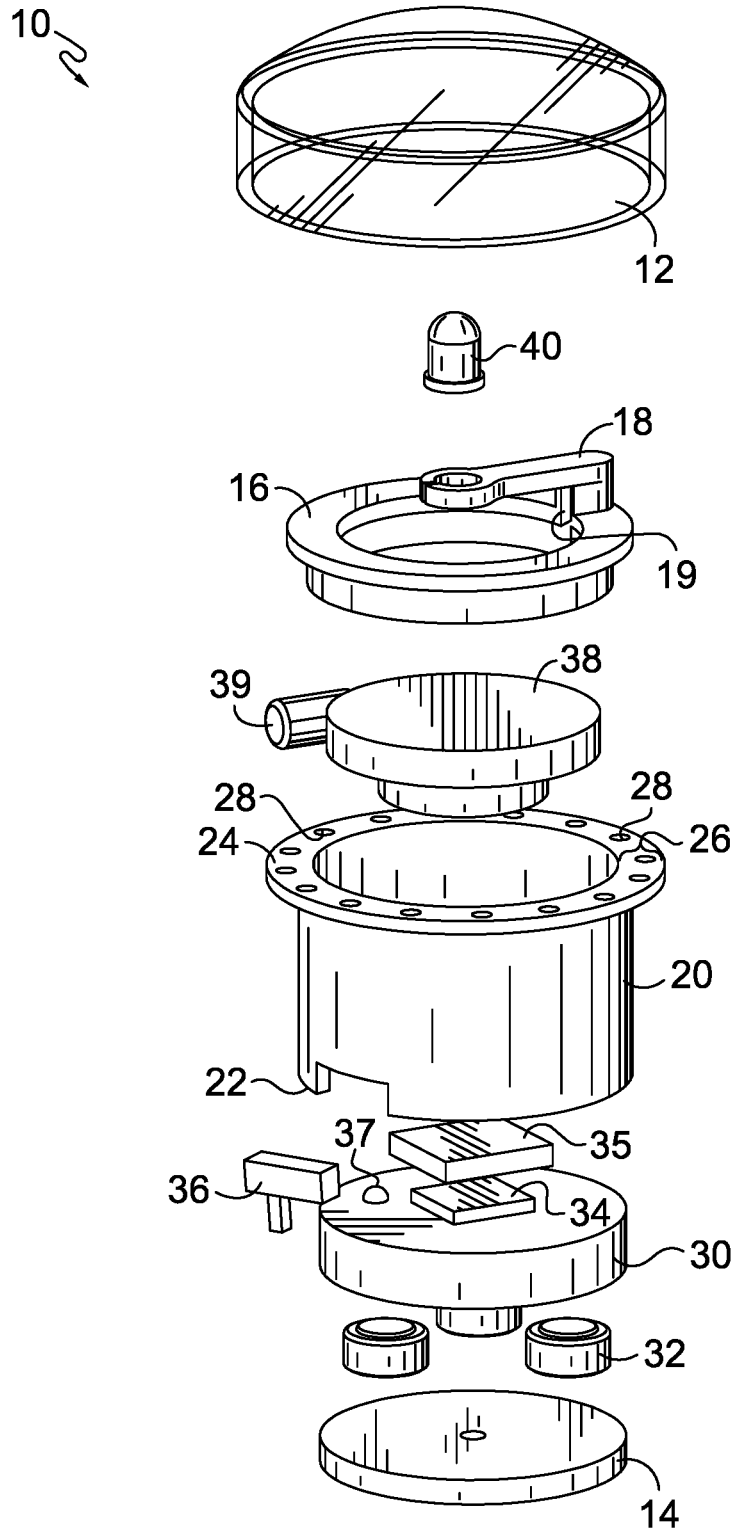
FIG. 2 is an exploded top perspective view of the apparatus according to FIG. 1.

Turning now to FIG. 2, more particular aspects of the apparatus 10 will now be described. Relative location terminology will be utilized herein to describe the position and location of the components of the illustrated apparatus 10, and will be discussed in more detail below. It should be noted, however, that the components could be in other positions and locations with respect to each other. FIG. 2 is an exploded top perspective view of the apparatus 10. As discussed above, the apparatus 10 includes a housing 20. The housing 20 may be described as having a bottom end 22 and a top end 24. The top end 24 may have a peripheral flange 26 with one or more apertures 28. The housing 20 may include a number of components electrically and/or communicatively coupled together and received therein.

Beginning generally with the bottom end 22 of the housing 20, in the illustrated exemplary embodiment, the housing 20 has a battery compartment 30 for receiving one or more batteries 32. An integrated circuit 34 may be positioned above the battery compartment 30. At least one input device (e.g., an on/off switch) 36 may also be (at least partially) positioned within the housing 20 and communicatively coupled to the integrated circuit 34. A divider 35 may be included to separate the integrated circuit 34 and the battery compartment 30 from the other components in the housing 20.

A speaker 38 may be positioned above the integrated circuit 34 (and the divider 35, in some aspects), and a light source 40 may be positioned above the speaker 38. Although elements 30-40 have been described as having locations relative to one another, the positions and locations thereof are merely exemplary in nature. The positions and/or orientation of elements 30-40 may be arranged in any suitable manner, and any and all such variations are contemplated to be within the scope of embodiments of the present invention.

The apparatus 10 may also include a removable plate 14 removeably affixed proximate the bottom end 22 of the housing 20 to allow one access to the battery compartment 30 to replace the batteries 32. As mentioned above, the apparatus 10 also includes a cap 12 removeably affixed proximate the top end 24 of the housing 20, such that light from the light source 40 may pass there through. In that regard, the cap 12 may be translucent or transparent, as desired.

Having provided an overview of the apparatus 10, more particular aspects of the structures and components that make up the apparatus 10 will now be discussed. In some aspects, the housing 20 may have a generally cylindrical structure, for example when configured for use in a tea light holder. However, the housing 20 may be any number of shapes, such as a square or rectangle, depending on the intended implementation of the apparatus 10. In the embodiment depicted in FIGS. 1-3, the housing 20 may include a peripheral flange 26 with one or more apertures 28. The one or more apertures 28 allow sound from the speaker 38 to travel out of the interior of the apparatus 10 and into a surrounding environment.

In some aspects, the battery compartment 30 may include the divider 35 between the one or more batteries 32 and the other components within the housing 20. Although shown as a separate structure in FIG. 2, the divider 35 may be integrally formed as part of the battery compartment 30, such that a top surface of the battery compartment 30 is substantially flat. Accordingly, the battery compartment 30 may include a recess (not shown) for receiving the integrated circuit 34.

In some aspects, the integrated circuit 34 may be adjacent to and affixed to the battery compartment 30, or received therein. In another aspect, the integrated circuit 34 may be covered by the divider 35 such that the integrated circuit 34 and the battery compartment 30 are separated from the other components within the housing 20. As mentioned above, the apparatus 10 may produce a number of lighting and sound effects. The integrated circuit 34 may include a memory that stores a library of effects, which may include routines or programs with corresponding lighting patterns and sounds. Accordingly, for some programmed effects, the lighting and sound effects may change according to the programmed effect in order to create certain mood.

The input device 36 may be any type of device suitable for communicating with the integrated circuit 34 to control operation of the apparatus 10. For example, the input device 36 may be a toggle switch that can be toggled between different positions corresponding to operating states. In another example, the input device 36 may be a push button that can be pushed repeatedly to select various modes or operating states and to switch there between. In another aspect, the input device 36 may be a wireless transceiver that receives instructions from a device wirelessly coupled to the apparatus 10. For example, the wireless transceiver may be a Bluetooth or Wi-Fi transceiver.

By way of example, the operating states may include: off; sound and light; light only; sound only; a demonstration state; and an automatic state. When the apparatus 10 is in the sound and light operating state, the apparatus 10 may produce sound and lighting effects that correspond with one another according to a preprogrammed effect stored in the library. When in the light only operating state, the light may produce a variety of lighting effects. For example, the apparatus 10 may be programmed to cause the light source 40 to flicker in a manner that mimics a candle. The speaker 38 may emit any number of sounds, which may be produced when in the sound only operating state without a corresponding lighting effect. When in the demonstration state, the apparatus 10 may produce the various effects and operating states continuously in a cycle or loop.

In some aspects, the apparatus 10 may include a sensor 37 in addition to or in place of the input device 36. The sensor 37 may be configured to communicate with the integrated circuit 34 and to activate or deactivate the apparatus 10, when the apparatus 10 is in the automatic operating state. For example, the sensor 37 may comprise a light sensor, a sound sensor, a movement sensor, and/or a motion sensor. As can be appreciated, the light sensor may activate the apparatus 10 when a light level in the surrounding environment is below or above a given level. Additionally, the sound sensor and the motion sensor may activate the apparatus 10 when sounds or motion are detected in the surrounding environment. The movement sensor may activate the apparatus when movement of the apparatus is detected, irrespective of detecting motion in the surrounding environment. This could be useful when the apparatus is placed inside an object and the object is being moved. In that case the surrounding environment may not change, but movement of the apparatus could still be detected. In another aspect, the sensor 37 may comprise a timer for determining when the apparatus 10 is activated or deactivated. In some aspects, the apparatus 10 may be programmable such that a customized time for activation and/or deactivation may be established by a user. As can be appreciated, a number of preprogrammed time periods may also be stored in the memory for selection via the input device 36.

In the first illustrated embodiment, the speaker 38 is positioned inside an annular support ring 16 and the annular support ring 16 is received in the housing 20. In this aspect, the annular support ring 16 has an annular rim that rests on top of (or is coupled to) the peripheral flange 26 of the housing 20. A capacitor 39 may also be received in the housing 20 and positioned below the speaker 38. In the instant embodiment, the sound from the speaker 38 is emitted from the top end 24 of the housing 20 up toward the bottom of the cap 12, where it is reflected back down toward the peripheral flange 26. Specifically, the one or more apertures 38 of the peripheral flange 26 allow the sound from the speaker 38 to exit out of the interior of the apparatus 10.

In this embodiment the light source 40 is held in place by an arm 18 that extends upwardly from the annular support ring 16 and toward a center of the apparatus 10. The arm 18 may include a channel 19 for holding wires (not shown) that connect the light source 40 to the other electrical components. The channel 19 may cooperate with a slot (not shown) in the ring 18 to guide the wires around the speaker 38. The light source 40 may be a light-emitting diode (LED) or other suitable type of light source 40. Additionally, the light source 40 may include multiple bulbs or other light emitting structures. In one aspect, the light source 40 may be a red-blue-green (RBG) light for producing various colors.

The removable plate 14 may provide access to the battery compartment 30 when the removable plate 14 is removed, such that the one or more batteries 32 may be accessed and replaced. In some aspects, the removable plate 14 also orients the one or more batteries 32, and holds them in place. The removable plate 14 may be configured to fit within the housing 20, or may form the bottom end 22 of the housing 20 when the removable plate 14 is affixed to the housing 20.

The cap 12 may be transparent or translucent. In one aspect, the cap 12 may be a frosted, translucent, dome-shaped cover to improve illumination and diffuse the light from the light source 40, such that the cap 12 glows and appears to be the source of the light. Further, a translucent cap 12 may obscure visibility of the components inside the apparatus 10, but still allow light from the light source 40 to emanate from the apparatus 10. A translucent cap 12 may also diffuse the light from the light source 40 to provide a glowing effect. Further, the cap 12 may come in a variety of colors, such that the light emitted from the apparatus 10 is the color of the cap 12. In one aspect, the cap 12 may be partially transparent and partially translucent or opaque. In this aspect, shapes or designs may be formed on the cap 12 by selectively locating the translucent or opaque portions, such that the shapes or designs are projected from the apparatus 10 when the light source 40 is on. Additionally, the cap 12 may be interchangeable. For example, a single apparatus 10 may have a variety of different colored and/or types of caps affixed thereto, as desired by a user.

Figure 3:
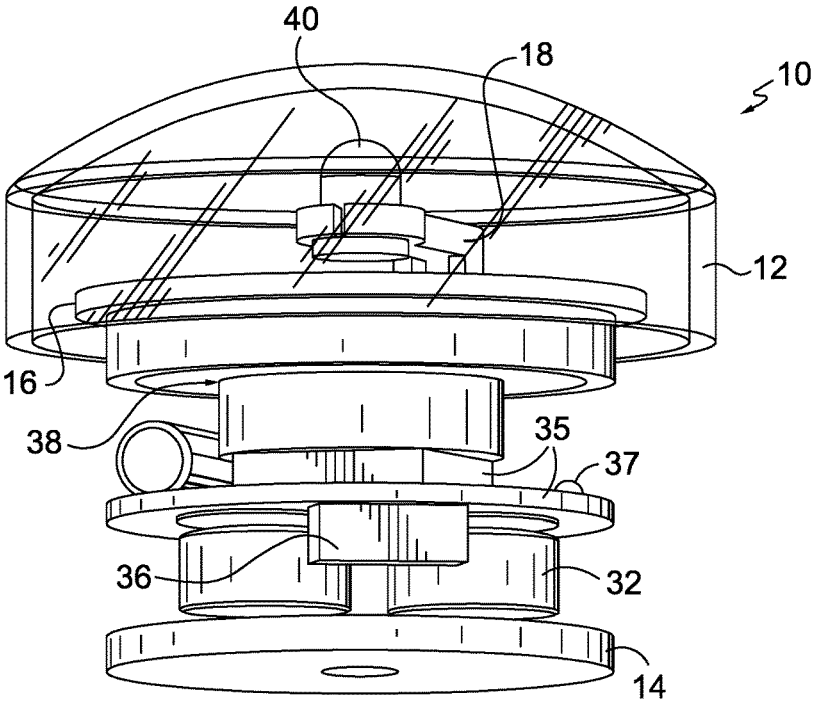
FIG. 3 is a bottom perspective view of the apparatus according to FIGS. 1 and 2 with the housing hidden.

FIG. 3 provides a bottom perspective view of the apparatus 10 with the housing 20 hidden to illustrate one way in which the components may be arranged inside the housing 20. The one or more batteries 32 may be positioned between the removable plate 14 and the divider 35. As can be appreciated, the housing 20 may form a portion of the battery compartment 30, such as sidewalls for retaining the one or more batteries 32. The integrated circuit 34 is hidden by divider 35 in the present view, as the divider 35 separates the integrated circuit 34 and the one or more batteries 32 from the other components in the housing 20. Although shown as being positioned below the divider 35, the input device 36 may also be positioned above the divider 35. The speaker 38 may be positioned above and separated (by the divider 35) from the integrated circuit 34 and the one or more batteries 32. As mentioned above, the speaker 38 may be retained within annular support ring 16. Finally, the light source 40 may be positioned above the speaker 38 and held in place by the arm 18.

Figure 4:
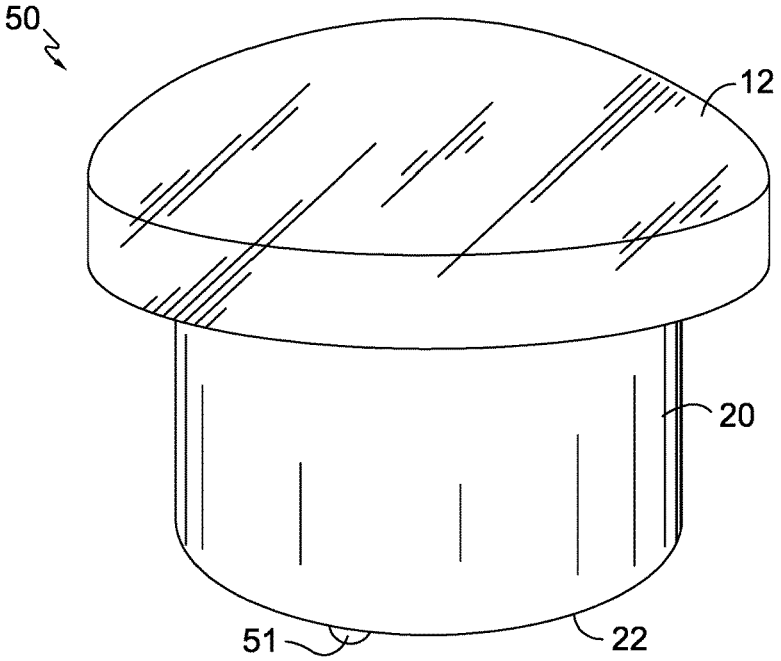
FIG. 4 is a top perspective view of an assembled apparatus for producing light and sound with a cap on a housing, in accordance with a second embodiment of the present invention.

Turning now to a second embodiment, FIG. 4 is a top perspective view of an assembled apparatus 50 with the cap 12 on the housing 20. In the second embodiment, the sound passes through the bottom end 22 of the housing 20. Accordingly, the housing 20 includes feet 51 that lift the bottom of the housing 20 off of a surface upon which the apparatus 50 is placed to leave a space between the bottom of the housing 20 and the surface to allow the sound to exit the apparatus 50.

Figure 5:
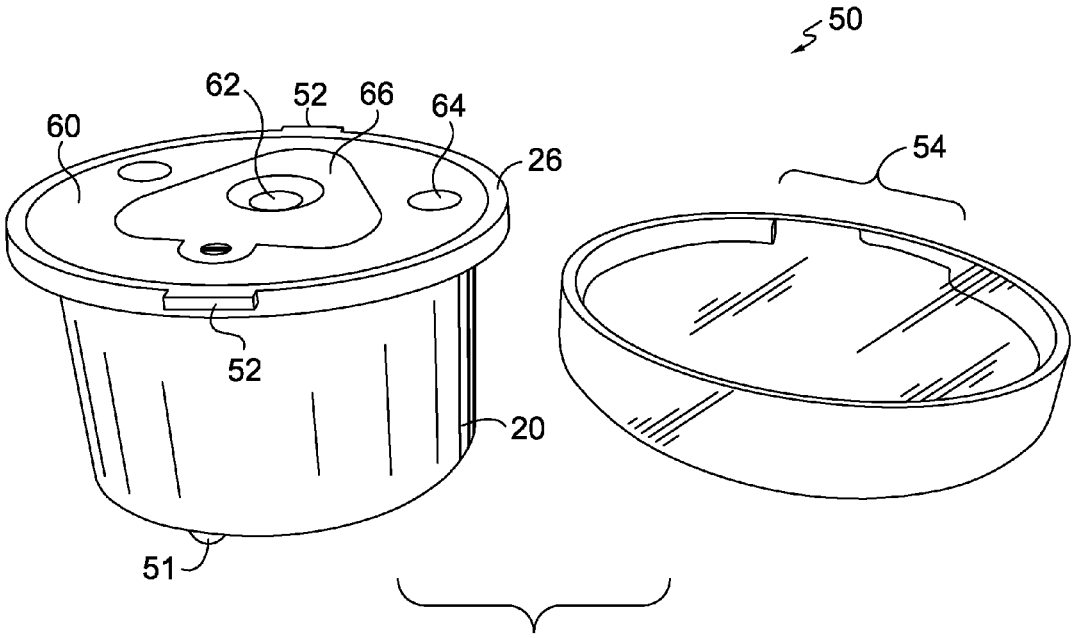
FIG. 5 is a top perspective view of the apparatus according to FIG. 4 with the cap removed from mating cooperation with the housing.

In FIG. 5, a top perspective view of the apparatus 50 according to FIG. 4 with the cap 12 removed from mating cooperation with the top of the housing 20 is depicted. In this embodiment, the flange peripheral 26 has a pair of ears 52 that project outwardly from the peripheral flange 26. The ears 52 are received in a groove 54 on the inside of the cap 12. The cap 12 is placed down over the ears 52 with grooves 54 aligned with the ears 52. A user then turns the cap 12 clockwise to move the ears 52 along the grooves 54 to secure the cap 12 to the housing 20.

Figure 6:
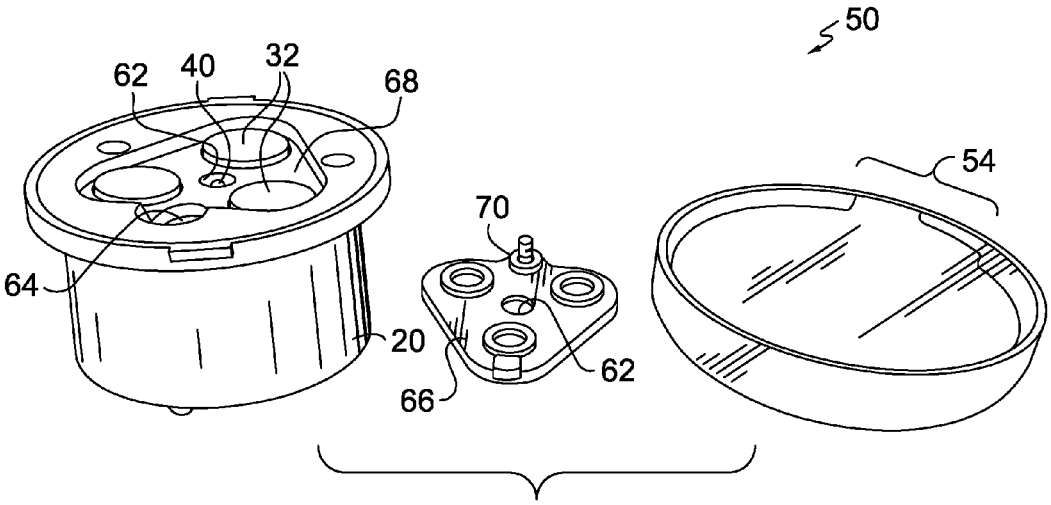
FIG. 6 is a top perspective view of the apparatus according to FIGS. 4 and 5 with a battery cover tray removed.

The housing 20 may include a top plate 60 that substantially covers the components received within the housing 20 discussed above, including the light source 40 (shown in FIG. 6). The top plate 60 may include one or more screw holes 64 for receiving screws to affix the top plate 60 to the housing 20. Although screws are described as an exemplary fastening mechanism, any suitable means of fastening the top plate 60 to the housing 20 is contemplated herein and considered within the scope of the invention. A battery cover tray 66 may be removeably affixed to the top plate 60 to hold the one or more batteries 32 (shown in FIG. 6) in place. The battery cover tray 66 (and the top plate 60) may include an opening 62 that allows light from the light source 40 to illuminate the cap 12.

In FIG. 6 the battery cover tray 66 is removed to reveal the one or more batteries 32. The top plate 60 may include a recess 68 for receiving the one or more batteries 32 and mating with the battery cover tray 66. The battery cover tray 66 may have a screw boss 70 that aligns with a screw hole 64 in the top plate 60 to hold the one or more batteries 32 in place.

Figure 7:
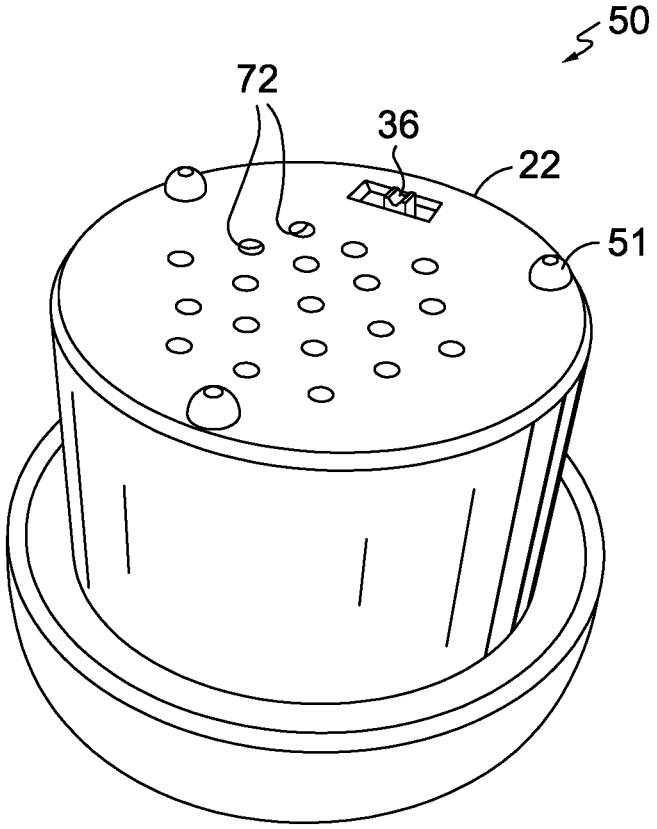
FIG. 7 is a perspective view of a bottom of the apparatus according to FIGS. 4-6.

FIG. 7 is a perspective view of the bottom of the apparatus 50. In this embodiment, the bottom of the housing 20 includes a plurality of bottom apertures 72 that allow sound from the speaker 38 to exit the housing 20. The input device 36 may also extend through the bottom of the housing 20. As can be appreciated, in this embodiment, the speaker 38 is arranged to direct sound downwardly and is preferably adjacent the bottom of the housing 20. Accordingly, although not shown here, the electrical components described hereinabove with reference to FIGS. 1-3 (such as integrated circuit 34 and capacitor 39) may be disposed within the housing 20 between the speaker 38 and the top plate 60.

As briefly described hereinabove, relative location terminology is utilized herein to describe the position and location of the components of the apparatus. For example, the term "proximate" is intended to mean on, about, near, by, next to, at, and the like. Therefore, when a feature is proximate another feature, it is close in proximity but not necessarily exactly at the described location, in some aspects. Terminology relating to relative positions of various features of the apparatus is also used herein. For example, the terms "lower" and "bottom" refer to a portion of the apparatus that is near a surface upon which the apparatus rests. Accordingly, the terms "upper" and "top" refer to a portion of a feature that is further from the surface upon which the apparatus rests than a lower or bottom feature of the apparatus. Further, as used herein, the terms "above" and "below" refer to a position of a feature relative to another feature with respect to parallel, with parallel being the surface of the earth.

From the foregoing, it will be seen that this invention is one well adapted to attain all the ends and objects hereinabove set forth together with other advantages, which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The claimed invention is:

1. An apparatus for producing light and sound, the apparatus comprising:

a housing having a bottom end and a top end, the top end having a peripheral flange with one or more apertures, the housing having received and electrically together coupled therein:

a battery compartment for receiving one or more batteries;

an integrated circuit;

a speaker;

a light source; and at least one input device communicatively coupled to the integrated circuit;

a removable plate removably affixed to the housing proximate the bottom end of the housing and covering the battery compartment; and a cap removably coupled with the top end of the housing, the cap allowing light from the light source to pass there through.

2. The apparatus of claim 1, wherein the cap is dome-shaped, wherein the housing is cylindrical, and wherein activation of the apparatus causes at least one of the light source to illuminate the cap and the speaker to emit sound.

3. The apparatus of claim 1, wherein the cap is translucent.

4. The apparatus of claim 1, wherein the integrated circuit includes a memory storing a plurality of preprogrammed routines.

5. The apparatus of claim 4, wherein the at least one input device is employed to select a preprogrammed routine from the memory and causes the routine to be activated.

6. The apparatus of claim 1, wherein the at least one input device transitions the apparatus between a plurality of operating states.

7. The apparatus of claim 6, wherein the plurality of operating states comprise:

off;

sound and light;

light;

sound;

demonstration; and automatic.

8. The apparatus of claim 1, further comprising a capacitor electronically coupled with the speaker and received in the housing.

9. An apparatus for producing light and sound, the apparatus comprising:

a housing having a bottom end and a top end, the housing having received and electrically together coupled therein:

a battery compartment for receiving one or more batteries;

an integrated circuit;

a speaker positioned proximate the bottom end of the housing;

a light source; and at least one input device communicatively coupled to the integrated circuit;

a battery cover tray removably affixed to the housing proximate the top end of the housing and covering a battery recess; and a cap removably coupled with the top end of the housing, the cap allowing light from the light source to pass there through; and at least three feet positioned below the bottom end of the housing, such that a space is created at the bottom of the housing that allows sound from the speaker to exit the housing.

10. The apparatus of claim 9, wherein the cap is dome-shaped, wherein the housing is cylindrical, and wherein activation of the apparatus causes at least one of the light source to illuminate the cap and the speaker to emit sound.

11. The apparatus of claim 9, wherein a bottom of the housing includes a plurality of bottom apertures that allow sound from the speaker to exit the housing.

12. The apparatus of claim 9, wherein the integrated circuit includes a memory storing a plurality of preprogrammed routines.

13. The apparatus of claim 12, wherein the at least one input device is employed to select a preprogrammed routine from the memory and causes the routine to be activated.

14. The apparatus of claim 9, wherein the at least one input device transitions the apparatus between a plurality of operating states.

15. The apparatus of claim 14, wherein the plurality of operating states comprise:

off;

sound and light;

light;

sound;

demonstration; and automatic.

* * * * *